US007118605B2

(12) United States Patent
Degen et al.

(10) Patent No.: US 7,118,605 B2
(45) Date of Patent: Oct. 10, 2006

(54) FUEL CONDITIONING PROCESS

(75) Inventors: Winfried Degen, Esslingen (DE); Erwin Loeffler, Friedrichshafen (DE); Carsten Plog, Markdorf (DE); Melanie Schnell, Ahaus (DE); Thomas Stengel, Friedrichshafen (DE)

(73) Assignee: DaimlerChrysler AG, Stuttgart (DE)

( * ) Notice: Subject to any disclaimer, the term of this patent is extended or adjusted under 35 U.S.C. 154(b) by 507 days.

(21) Appl. No.: 10/066,881

(22) Filed: Feb. 4, 2002

(65) Prior Publication Data

US 2002/0144456 A1 Oct. 10, 2002

(30) Foreign Application Priority Data

Feb. 17, 2001 (DE) ..... 101 07 616

(51) Int. Cl.
*C10L 1/222* (2006.01)

(52) U.S. Cl. ..... 44/413; 44/414; 44/603

(58) Field of Classification Search ..... 44/413, 44/300, 603, 414
See application file for complete search history.

(56) References Cited

U.S. PATENT DOCUMENTS 4,334,889 A 6/1982 Takabayashi ..... 44/50
4,469,904 A 9/1984 Wang et al. ..... 568/948
4,517,393 A 5/1985 Wang et al. ..... 568/948
4,524,226 A 6/1985 Wang et al. ..... 562/948
5,457,958 A 10/1995 Boegner et al. ..... 60/279
5,699,776 A * 12/1997 Wood et al. ..... 123/531
5,817,282 A * 10/1998 Radlein et al. ..... 423/235

FOREIGN PATENT DOCUMENTS

| | | |
|---|---|---|
| DE | 4319294 | 5/1994 |
| JP | 7900487 | 7/1979 |
| JP | 60169660 | 9/1985 |
| WO | WO 79 00 487 | 7/1979 |

* cited by examiner

*Primary Examiner*—Cephia D. Toomer
(74) *Attorney, Agent, or Firm*—Davidson, Davidson & Kappel, LLC

(57) ABSTRACT

The present invention relates to a fuel conditioning process for internal combustion engines of motor vehicles. According to the present invention, on board a motor vehicle at a temperature of from 20° C. to 150° C. and at atmospheric pressure, nitrous gases essentially including nitrogen monoxide, nitrogen dioxide, or dinitrogen monoxide, or gaseous mixtures thereof are passed through the liquid fuel of the motor vehicle, nitro compounds being formed in the fuel as a result of the passing through of the nitrous gases through the fuel.

8 Claims, 2 Drawing Sheets

FUEL CONDITIONING PROCESS

Priority to German Patent Application No. 101 07 616.9-13, file Feb. 17, 2001 and incorporated-by-reference herein, is respectfully requested.

BACKGROUND INFORMATION

The present invention relates to a fuel conditioning process for internal combustion engines of motor vehicles.

The improvement of fuel properties has positive effects on the cold-start performance, the exhaust-gas emission as well as the combustion noises of the internal combustion engine of a motor vehicle. Thus, for example, a Diesel fuel having a high cetane number brings about a reduction of the hydrocarbon and carbon-dioxide emissions as well as a reduction of the detrimental engine knock.

The cetane number of the Diesel fuel can be increased, for example, by ignition improvers. Ignition improvers that have proven efficient include additives, in particular, alkyl nitrates such as isopropyl nitrate, amyl nitrate, cyclohexyl nitrate or octyl nitrate as well as organic nitrites, nitro compounds or peroxides.

Known from Word Patent Application WO 79/00487 A12 and Japanese Patent 60 169 660 are methods for improving the fuel quality by introducing oxygen into fuel tanks.

U.S. Pat. No. 4,469,904 describes a process for selectively forming nitro compounds. In the process, organic carboxylic acids having from two to ten hydrocarbon atoms are contacted, at temperatures above 200° C. and pressures between 1 and 10 bars in a homogeneous gas phase, with nitrogen dioxide ($NO_2$) or nitric acid ($HNO_3$) in pure form, respectively, or in the presence of oxygen and/or water. A similar process for selectively nitrating aldehydes and ketones is disclosed in U.S. Pat. Nos. 4,524,226 and 4,517,393. The disclosed processes have the disadvantage that a lot of energy is required due to the elevated temperature and the increased pressure.

SUMMARY OF THE INVENTION

An object of the present invention is to specify a process for improving the properties of fuel.

The present invention provides a fuel conditioning process for internal combustion engines of motor vehicles. According to the present invention, on board a motor vehicle at a temperature of from 20° C. to 150° C. and at atmospheric pressure, nitrous gases essentially including nitrogen monoxide, nitrogen dioxide, or dinitrogen monoxide, or gaseous mixtures thereof are passed through the liquid fuel of the motor vehicle, nitro compounds being formed in the fuel as a result of the passing through of the nitrous gases through the fuel.

It is an advantage of the present invention that the process can take place at low temperatures and at atmospheric pressure so that no additional expenditure of energy is required. Moreover, no catalytic converter is required for forming the nitro compounds. This results in further advantages with regard to space and energy requirements.

A further advantage of the process according to the present invention lies in that the ignition of the fuel-air mixture introduced into the combustion chamber of the motor vehicle is accelerated by the nitro compounds which are formed and bound in the fuel. Thus, for example, the cetane number of Diesel fuel is increased by the process according to the present invention. This results in an improved combustion of the fuel during which the nitrogen oxides are burnt as well. In this manner, the nitrogen-oxide emission of the motor vehicle is reduced. Moreover, an improved combustion of the fuel results in a reduction of the concentration of unburnt fuel components such as hydrocarbon components in the exhaust gas.

The fuel which has been treated with the nitrous gases can advantageously be used for the cold-start phase of the internal combustion engine. Because of this, further advantages ensue with regard to a reduced emission of pollutants during the starting phase of the engine and to the service life thereof. Furthermore, the light-off temperature of exhaust gas after treatment catalysts arranged downstream of the internal combustion engine can be reduced via the treated fuel.

Gasoline or Diesel fuel, kerosene or alcohols can be advantageously used as fuel.

In an advantageous embodiment of the present invention, provision is made for a storage-type catalytic converter through which the exhaust gas is passed and at which the nitrogen oxides are adsorbed from the exhaust gas of the internal combustion engine, thus being concentrated. Prior to introducing the concentrated nitrogen oxides into the fuel for forming nitro compounds in the fuel, the nitrogen oxides are desorbed by the storage-type catalytic converter. This can be achieved using known measures such as heating the storage-type catalytic converter for a short time or by a rich fuel-air mixture during a short time for raising the combustion temperature. However, it is also possible for the nitrous gases not to be passed through the fuel in pure form but in an atmosphere which is rich in oxygen or nitrogen. In an advantageous embodiment of the present invention, it is also possible to tap off a partial flow of the exhaust gas and to introduce it into the fuel.

In a further advantageous embodiment of the present invention, it is possible to use the heat of the cooling and heating systems of the motor vehicle to control the temperature of the process according to the present invention. In this context, the heat of the engine oil can be used as well. This results in further structural, in particular space- and energy-saving advantages.

BRIEF DESCRIPTION OF THE DRAWINGS

The present invention will be explained in greater detail with reference to drawings and on the basis of examples.

DETAILED DESCRIPTION

Figure 1:
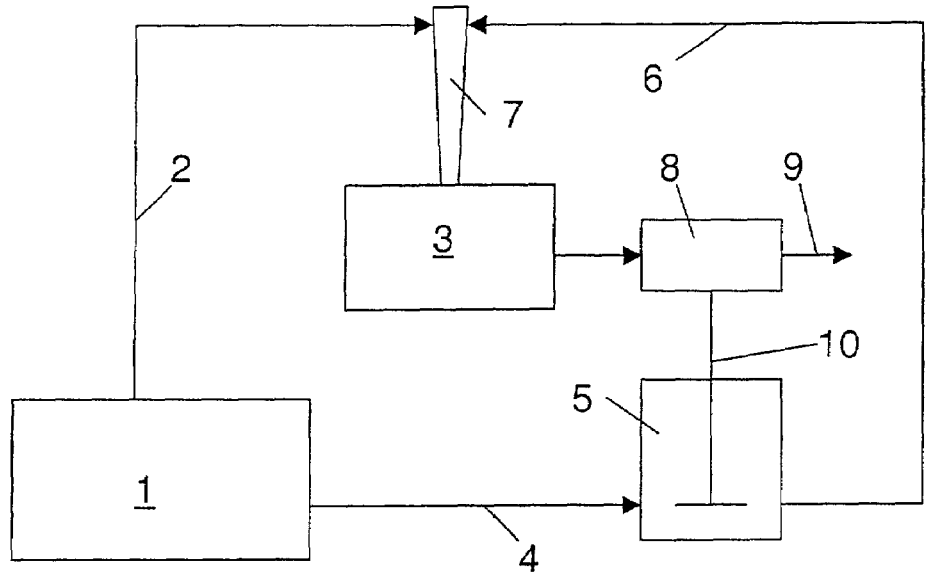
FIG. 1 depicts the design of a device on board a motor vehicle for carrying out the process according to the present invention.

FIG. 1 depicts the design of a device on board a motor vehicle for carrying out the process according to the present invention. A fuel tank 1 for storing the original fuel is provided in the motor vehicle (not shown), the fuel tank supplying fuel via a line 2 to internal combustion engine 3 and via a line 4 to gassing unit 5. The fuel which has been treated in the gassing unit, also referred to as starting fuel, is fed to internal combustion engine 3 via line 6. For feeding the fuel into internal combustion engine 3, provision is made for a bi-fuel injector 7. Using bi-fuel injector 7, it is possible for the starting fuel to be metered into the original fuel from fuel tank 1 and to be fed into internal combustion engine 3. The combustion gas of engine 3 is fed to a nitrogen oxide storage-type catalytic converter 8 in which the nitrogen oxides are adsorbed. Downstream of nitrogen oxide storage-type catalytic converter 8, the combustion gas is discharged through exhaust branch 9 of the motor vehicle as exhaust gas.

The nitrogen oxides adsorbed in storage-type catalytic converter 8 can be desorbed, for example, via thermal heating of storage-type catalytic converter 8. The desorbed nitrogen oxides are fed to gassing unit 5 via a line 10. In this connection, it is, of course, also possible for the desorbed nitrogen oxides to be introduced into the gassing unit not only in concentrated form but also in an atmosphere containing oxygen or nitrogen.

Figure 2:
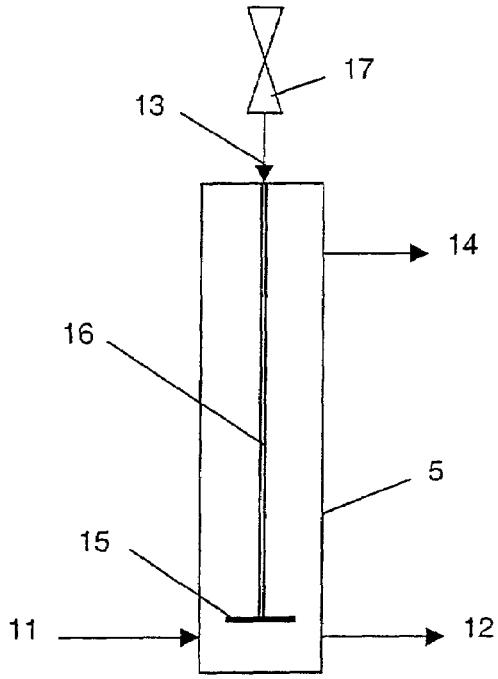
FIG. 2 shows the design of a gassing unit according to the present invention.

FIG. 2 shows the design of a gassing unit according to the present invention. Gassing unit 5 is substantially a closed vessel, for example, of steel or plastic, having feed and discharge lines for the fuel 11, 12 as well as feed and discharge lines for the nitrous gases 13, 14. In this context, the nitrous gases are introduced into vessel 5 via a tubular line 16. A valve 17 is connected within line 16 so as to allow a predetermined quantity of nitrous gases to be introduced into gassing vessel 5 for a predetermined time. Additionally, provision can be made for a control unit which closes valve 17 after a predetermined time or after a predetermined quantity has flown through.

In this context, tubular line 16 is terminated with a porous gas plate 15 inside of vessel 5. Gas plate 15 serves for forming small gas bubbles in the fuel while the nitrous gases are passed through the fuel. The resulting larger surface between the liquid fuel and the nitrous gas improves the formation of the nitro compounds in the fuel. The nitrous gases which have passed through the fuel are conveyed from vessel 5 into the exhaust system of the motor vehicle via discharge line 14 subsequent to passing through the fuel.

The fuel is conveyed from the fuel tank into gassing vessel 5 via supply line 11. The treated fuel is then led out of gassing vessel 5 via discharge line 12 and fed to the internal combustion engine as starting fuel.

Figure 3:
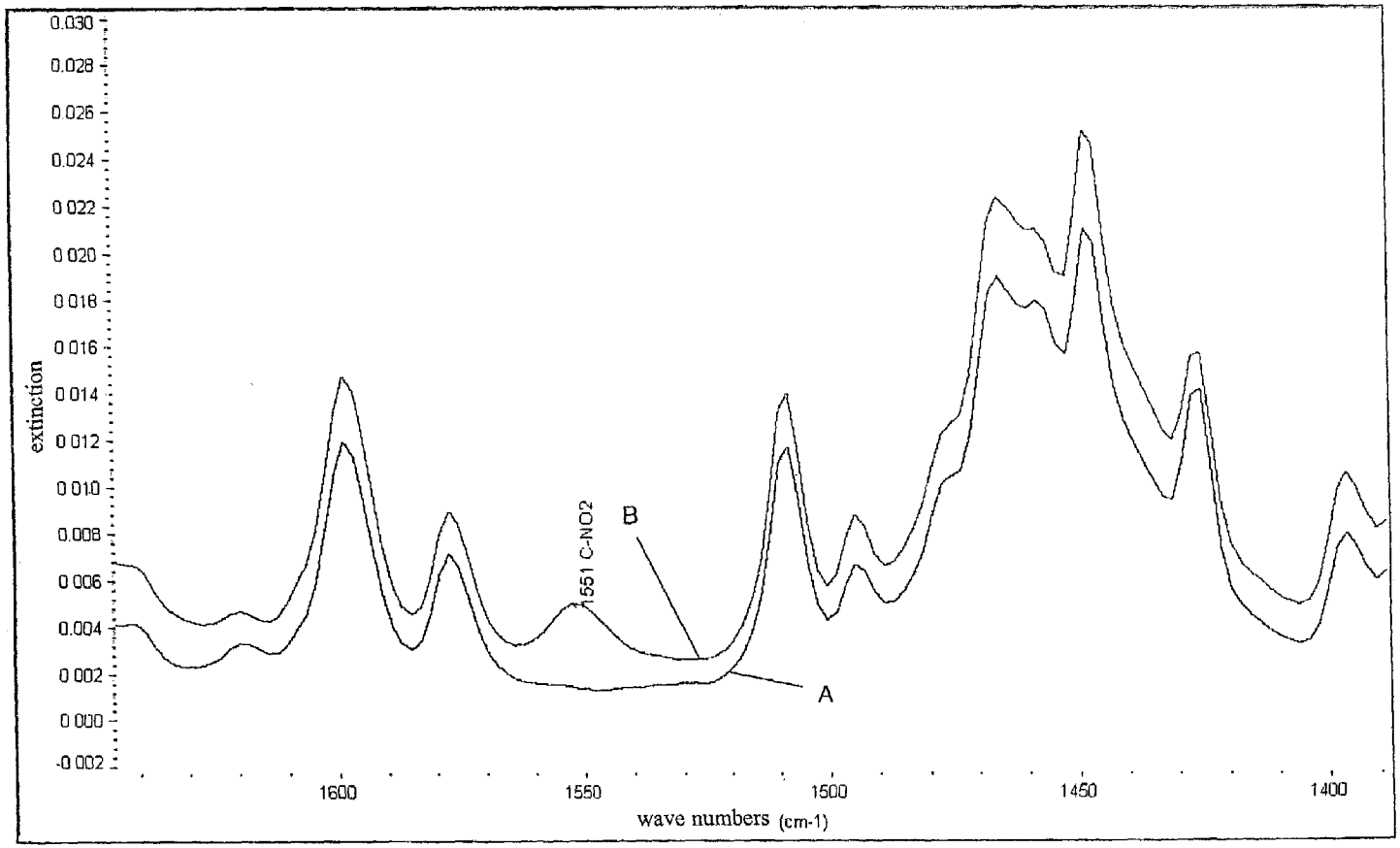
FIG. 3 is a section of an exemplary infrared spectrum of synthetic Diesel fuel as opposed to synthetic Diesel fuel which was treated with an $NO_2(1\%)/O_2$ mixture.

FIG. 3 shows a section of an exemplary infrared spectrum, the extinction being represented in arbitrary units over the wave number in $cm^{-1}$. The infrared spectrum of synthetic Diesel fuel A is contrasted therein to the infrared spectrum of synthetic Diesel fuel B which was treated with an $NO_2(1\%)/O_2$ mixture. The spectrum shows a wave number range of from 1390 $cm^{-1}$ to 1650 $cm^{-1}$. The essential components of the synthetic Diesel fuel are summarized in the following table:

| Compound | Content in % |
|---|---|
| 3-methylpentane | 5.19 |
| 4-methyl-1-pentene | 1.01 |
| 1,3,5,-trimethylbenzene | 3.20 |
| tert-butylbenzene | 4.23 |
| Indene | 3.80 |
| trans-decalin | 2.80 |
| Diethylbenzene | 2.81 |
| cis decalin | 2.33 |
| Tetralin | 5.58 |
| n-dodecane | 6.48 |
| 1-methylnaphtalene | 8.45 |
| 2,2,4,4,6,8,8-heptamethylnonane | 9.77 |
| Acenaphthylene | 7.87 |
| Acenaphthene | 0.69 |
| 1-acetylnaphthalene | 5.53 |

-continued

| Compound | Content in % |
|---|---|
| Benzophenone | 4.38 |
| 1-hexadecene | 2.97 |
| n-hexadecane | 7.33 |
| n-henicosane | 0.21 |

In the experiment, the synthetic Diesel fuel was treated, at a temperature of 21.5° C. during a gassing time of 30 minutes, with an $NO_2/O_2$ mixture having an $NO_2$ concentration of 1%. In the process, the flow rate of the $NO_2/O_2$ mixture was 96 ml/mm. After the elapse of the gassing time, the synthetic Diesel fuel was washed with $N_2$ for 5 minutes. In FIG. 3, the spectroscopic examination of treated synthetic Diesel fuel B shows an additional band at a wave number of 1551 $cm^{-1}$ as opposed to untreated synthetic Diesel fuel A. The additional band is attributable to the nitro compounds with a C—$NO_2$ bond. This experiment serves only to illustrate the feasibility and that nitro compounds are formed in the fuel due to the treatment of the synthetic Diesel fuel. A spectroscopic examination of original Diesel fuel would not yield any meaningful result because of the multitude of components.

In a further experiment, original Diesel fuel was treated with an $NO_2/O_2$ mixture having an $NO_2$ concentration of 1% under the conditions described above. A subsequent measurement of the cetane number showed a cetane number of 55.2 for the untreated original Diesel fuel. For the treated Diesel fuel, a cetane number of 59.3 ensued. This measurement indicates a formation of nitro compounds in the fuel.

An atmosphere rich in a certain component is defined herein to mean that the percentage content of the component is more than that of the component at standard sea level atmosphere.

What is claimed is:

1. A fuel conditioning method for internal combustion engines of motor vehicles, comprising:

passing nitrous gases through liquid fuel of a motor vehicle at a temperature of from 20° C. to 150° C. and at atmospheric pressure, the nitrous gases consisting essentially of at least one of nitrogen monoxide, nitrogen dioxide, dinitrogen monoxide, and gaseous mixtures thereof, nitro compounds being formed in the fuel as a result of the passing of the nitrous gases through the fuel.

2. The method as recited in claim 1 wherein the nitrous gases are passed through the fuel in an atmosphere rich in oxygen or nitrogen.

3. The method as recited in claim 1 further comprising producing the nitrous gases using a storage-type catalytic converter, the catalytic converter adsorbing the nitrogen monoxide, nitrogen dioxide, dinitrogen monoxide or gaseous mixtures thereof from exhaust gas of an internal combustion engine of the motor vehicle for concentration and desorbing the nitrogen monoxide, nitrogen dioxide, dinitrogen monoxide or gaseous mixture thereof prior to the passing step.

4. The method as recited in claim 1 further comprising passing a partial flow of exhaust gas from an internal combustion engine of the motor vehicle through the fuel.

5. The method as recited in claim 1 further comprising using the fuel after the passing step in a cold-start phase of an internal combustion engine of the motor vehicle.

6. The method as recited in claim 1 wherein a light-off temperature of exhaust gas aftertreatment catalysts is reduced via the treated fuel.

7. The method as recited in claim 1 wherein the fuel includes at least one of gasoline, Diesel fuel, kerosene and alcohol.

8. The method as recited in claim 1 further comprising using heat of at least one of a cooling system and heating system of the motor vehicle for controlling a temperature of the method.

* * * * *